US006974132B2

(12) United States Patent
Sorge

(10) Patent No.: US 6,974,132 B2
(45) Date of Patent: Dec. 13, 2005

(54) METHOD OF PLAY AND GAME SURFACE FOR A DICE GAME HAVING A PROGRESSIVE JACKPOT

(76) Inventor: Nicholas Sorge, 7 Susan Ct., Deer Park, NY (US) 11729

( * ) Notice: Subject to any disclaimer, the term of this patent is extended or adjusted under 35 U.S.C. 154(b) by 288 days.

(21) Appl. No.: 10/391,257

(22) Filed: Mar. 18, 2003

(65) Prior Publication Data

US 2005/0040593 A1 Feb. 24, 2005

(51) Int. Cl.[7] ..... A63F 3/00
(52) U.S. Cl. ..... 273/274; 273/146
(58) Field of Search ..... 273/274

(56) References Cited

U.S. PATENT DOCUMENTS

| | | | | |
|---|---|---|---|---|
| 2,871,581 A | | 2/1959 | Guzak | |
| 3,208,754 A | | 9/1965 | Sieve | |
| 3,904,208 A | | 9/1975 | Grossman | |
| 4,312,508 A | * | 1/1982 | Wood | 273/274 |
| 4,334,685 A | * | 6/1982 | Robbins et al. | 273/274 |
| 4,346,900 A | * | 8/1982 | Lamlee | 273/274 |
| 4,635,938 A | * | 1/1987 | Gray | 273/274 |
| 4,717,154 A | | 1/1988 | Miller | |
| 4,746,126 A | * | 5/1988 | Angileri | 273/249 |
| 4,900,034 A | | 2/1990 | Bereuter | |
| 4,902,019 A | * | 2/1990 | Berman | 273/256 |
| 5,224,708 A | | 7/1993 | Gathman et al. | |
| 5,308,081 A | * | 5/1994 | Bartle | 273/274 |
| 5,350,175 A | * | 9/1994 | DiLullo et al. | 273/146 |
| 5,413,351 A | * | 5/1995 | Franklin | 273/274 |
| 5,490,670 A | * | 2/1996 | Hobert | 463/20 |
| 5,513,851 A | * | 5/1996 | Harris | 273/274 |
| 5,673,916 A | | 10/1997 | Horan | |
| 5,785,596 A | * | 7/1998 | Hobert | 463/22 |
| 5,829,748 A | | 11/1998 | Moore, Jr. | |
| 5,909,874 A | | 6/1999 | Daniel et al. | |
| 5,961,117 A | | 10/1999 | Scarselli | |
| 6,116,603 A | | 9/2000 | Huang | |
| 6,176,489 B1 | * | 1/2001 | Astaneha | 273/274 |
| 6,179,293 B1 | | 1/2001 | Hedman | |
| 6,234,482 B1 | | 5/2001 | Henderson | |

* cited by examiner

*Primary Examiner*—Gregory Vidovich
*Assistant Examiner*—Dolores R. Collins
(74) *Attorney, Agent, or Firm*—Collard & Roe, P.C.

(57) ABSTRACT

A method and system for playing a dice game using a pair of dice. A primary player is first established at the beginning of the game. At least one wager is then made from each player establishing that one of a plurality of events will occur with the roll of the dice. The primary player then rolls the pair of dice. The wagers or bets are then resolved based on each roll of the dice. Wagers on at least one area of the game surface designated for wagers that the rolled dice will result in two specific identical numbers or doubles are paid out if the two specific identical numbers are rolled. The winner of this wager is then permitted to roll a single die if this winner also wagered on an area designated for a progressive bet. The progressive pot is paid to the winner if a single die results in a designated number. The game includes a playing surface for playing the game using a pair of dice and chips.

10 Claims, 3 Drawing Sheets

METHOD OF PLAY AND GAME SURFACE FOR A DICE GAME HAVING A PROGRESSIVE JACKPOT

BACKGROUND OF THE INVENTION

The invention relates to a method and game surface for playing a multi-sided dice game. More particularly, a dice game where the numbers are assigned colors and wherein the dice game has a game surface for wagering on different combinations of numbers and colors.

U.S. Pat. No. 5,909,874 to Daniel et al discloses icosahedron decimal dice. U.S. Pat. No. 3,904,208 to Grossman discloses a pseudo four dimensional dice and game where each die has 12 rhombic shaped faces. U.S. Pat. No. 4,900,034 to Bereuter discloses random gambling playing pieces and a game table.

SUMMARY OF THE INVENTION

The present invention includes a method of playing a dice game using a pair of dice and a game surface. A primary player is first established and at least one wager is made by each player on the game surface. The players wager that one of a plurality of events will occur with the roll of the dice. The primary player then rolls the pair of dice and the wagers are resolved. Losing wagers are collected, while winning wagers are paid according to the payout of the designated area of the game surface.

If a player wagered on an area of the game surface designated for two specific identical numbers, or doubles, and those two specific identical numbers are rolled, that player is paid the appropriate payout. If this winner also wagered on an area designated for a progressive bet associated with the winning doubles wager, that winner then rolls a single die. The winner is paid the progressive pot if the single die results in a designated number.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

DETAILED DESCRIPTION OF THE PREFERRED EMBODIMENT

Figure 1:
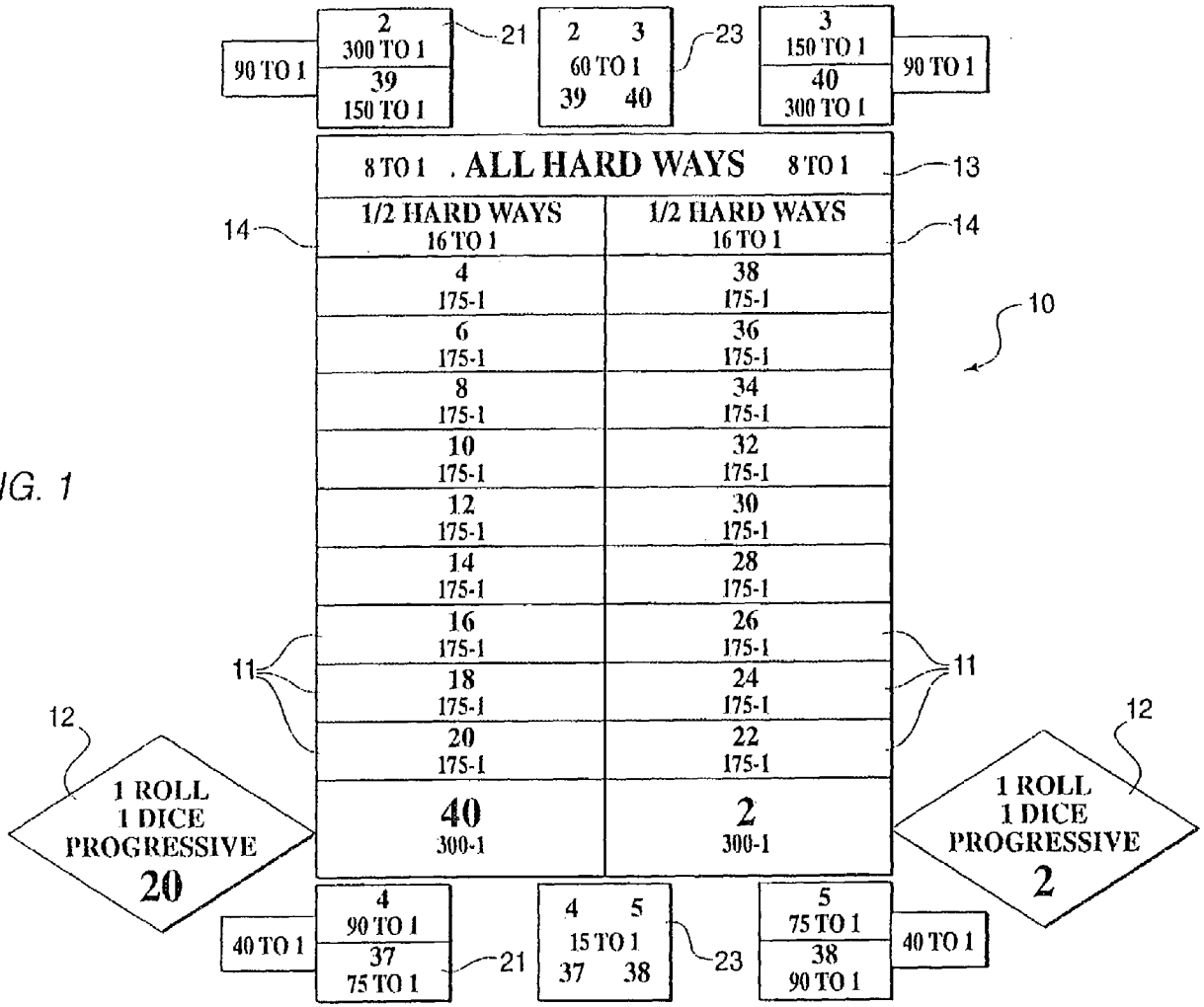
FIG. 1 shows a first embodiment of a primary playing area on the game surface.

Referring in detail to the drawing, FIG. 1 shows a primary playing area 10 of a game surface for a dice game preferably entitled "Throw Down." Primary playing area 10 comprises multiple wagering areas. The majority of primary playing area 10 consists of individual "hard way" wagering areas 11. Individual "hard way" wagering areas 11 are intended for wagers that the dice will result in two specific identical numbers. Each individual "hard way" wagering area is labeled with a single number. For example, a space labeled with the number "2" is intended for wagers that each die will produce a "1", with a double "1" resulting in a total of 2. Similarly, a space labeled with the number "10" is intended for wagers that each die will produce a "5."

Primary playing area 10 also has two progressive wagering areas 12. Each progressive wagering area 12 is associated with a single individual "hard way" wagering area 11. If a player wins on a wager placed on that individual "hard way" wagering area 11 that relates to progressive wagering area 12 and that player has also placed a wager on progressive wagering area 12, that player has a chance to win the progressive jackpot by rolling a single die. For example, in FIG. 1, progressive wagering area 12 relates to individual wagering areas 11 labeled with "2" and "40." A winning wager must be placed on individual wagering areas 11 labeled with "2" or "40" as well as the associated progressive wagering area 12 to have a chance to win the progressive jackpot.

Primary playing area 10 also includes an all "hard way" wagering area 13, for wagers that the dice will result in any set of doubles. Further, primary playing area 10 has two half "hard way" wagering areas 14. Individual "hard way" wagering areas 11 are arranged in two columns. Each half 14 is situated above a column. A wager placed on half "hard way" wagering area 14 wins if any of the doubles relating to individual "hard way" wagering areas 11 in that column wins.

Figure 2:
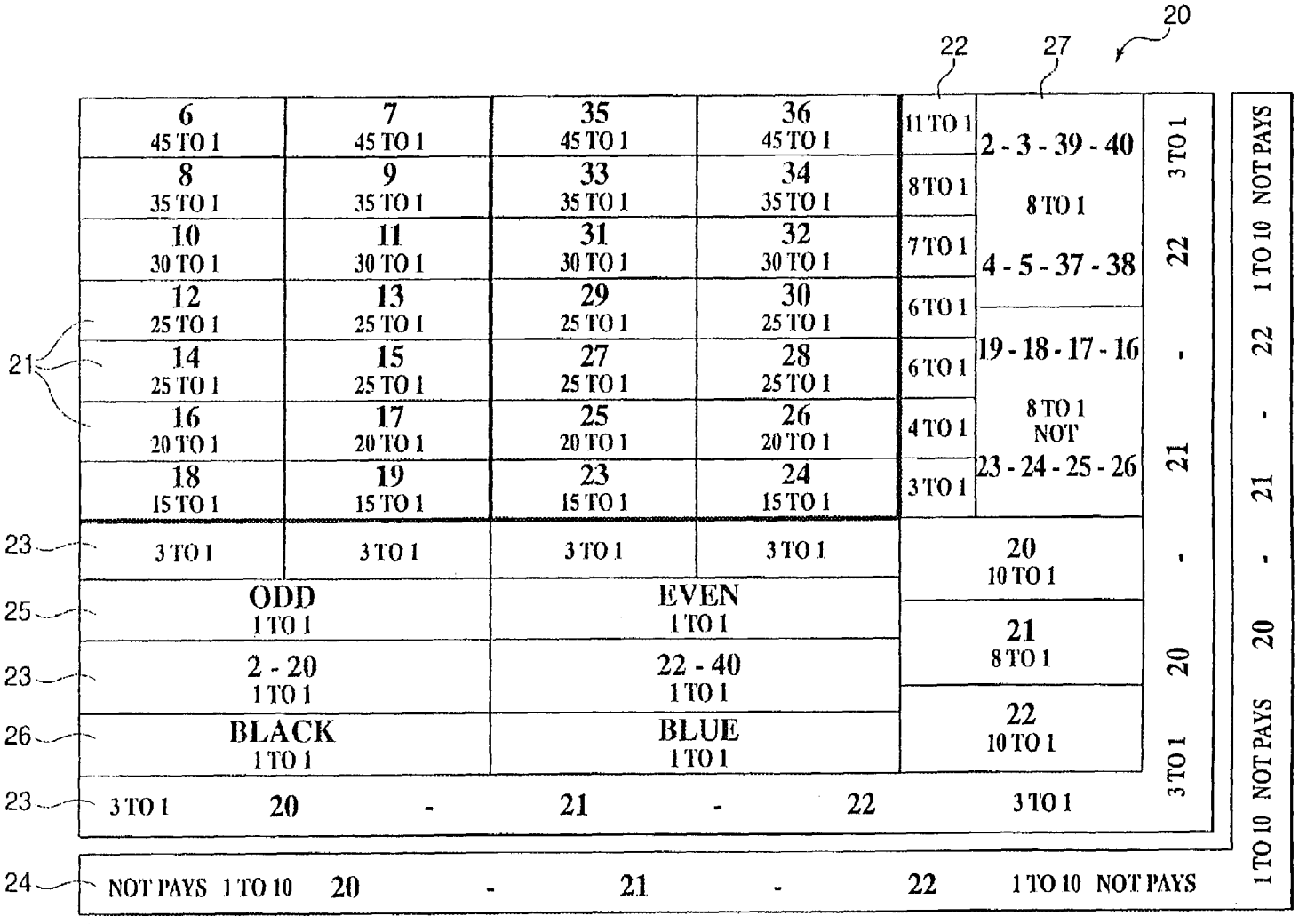
FIG. 2 shows a first embodiment of a secondary playing area on the game surface.

The playing surface also includes at least one secondary playing area 20 shown in FIG. 2. Secondary playing area 20 includes a plurality of individual number wagering areas 21. Individual number wagering areas 21 are each labeled with a single number. Wagers win if that number is rolled. Individual number wagering areas 21 are set up in a rectangular block so that players may also wager on rows of individual number wagering areas 22 and columns of individual number wagering areas 23. A wager on a row or column is a winning wager if an individual number in that row or column is rolled.

Secondary playing area 20 further includes a non-number wagering area 24 for wagers that specific numbers will not result. These wagers win if the numbers that are labeled on the areas are not rolled. Odd/even wagering areas 25 and color specific wagering areas 26 have winning wagers depending on whether the rolled number is odd or even and depending on what color the rolled number is. Finally secondary playing area 20 has a multiple specific numbers wagering areas 27, where a wager wins if one of the multiple numbers, or a number within the range of numbers, indicated on the area is rolled.

The dice game is played using a pair of multi-sided dice, preferably 20-sided dice, on a game surface. A primary player is established to roll the dice. Each player places at least one wager on the game surface, and the dice are rolled onto the game surface. The wagers are resolved after each dice roll. Losing wagers are collected and winning wagers are paid according to payouts of the areas on the game surface.

If a player wagered on individual "hard way" wagering area 11 that relates to progressive wagering area 12, and wagered on progressive wagering area 12, and that individual "hard way" was rolled, the player is paid for the winning wager and has a chance to win the progressive pot. The player is given a single die to roll and if that player rolls a specified number with the single die the player wins the progressive pot associated with progressive wagering area 12. If the player fails to roll the designated number, the wager is placed in the progressive pot.

Players may wager on any of the wagering areas of the game surface. Each wagering area has a designated payout indicated on its area. After the winning wagers have been paid out, new wagers are placed on the game surface by the players. The dice are then passed to the next player who then rolls.

Figure 3:
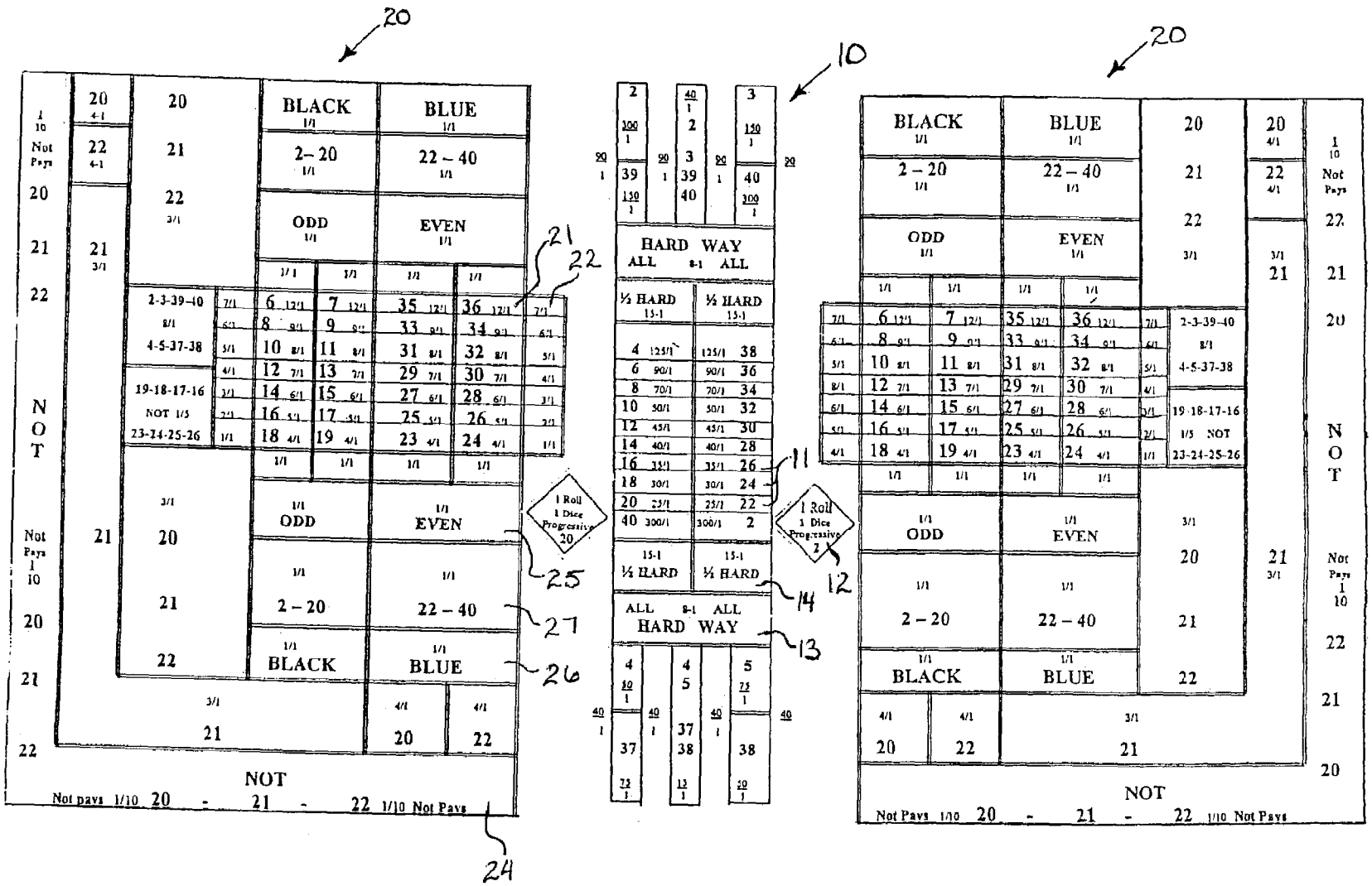
FIG. 3 shows a second embodiment of a game surface having a primary playing area and two secondary playing areas.

The game surface and the associated odds involved in playing the game with two twenty-sided dice is shown in FIGS. 1 and 2. An alternate game surface with alternate odds for twenty-sided dice is shown in FIG. 3. The surface and odds may be easily adapted for play with other dice including those with ten or twelve sides.

Accordingly, while two embodiments of the present invention has been shown and described, it is obvious that many changes and modifications may be made thereunto without departing from the spirit and scope of the invention.

What is claimed is:

1. A method of playing a dice game using a pair of dice on a game surface having wagering areas for individual numeric results, multiple possible numeric results, colors, doubles, and a progressive bet relating to at least one of the possible doubles, wherein each wagering area has its own payout for a successful wager, the method comprising the following steps:

establishing a primary player to roll the dice;

receiving at least one wager on the game surface from each player establishing that a selected one of a plurality of results will occur with the roll of the dice;

rolling the pair of dice on the game surface;

resolving said at least one wager from each player based on each roll of the dice, wherein losing wagers are collected and winning wagers are paid according to payouts of the areas on the game surface;

paying out to all wagers on one of a plurality of areas of the game surface designated for wagers that the rolled dice will result in two specific identical numbers, if said two specific identical numbers are rolled;

providing a winner of a wager requiring that the rolled dice will result in two specific identical numbers, with an additional roll of a single die before accepting new wagers, if said winner also wagered on an area designated for a progressive bet; and paying out a progressive pot to said winner if said single die results in a specified number.

2. The method of playing a dice game according to claim 1, wherein two 20-sided dice are used.

3. The method of playing a dice game according to claim 1, further comprising the step of establishing a new primary player with every roll of the dice.

4. The method of playing a dice game according to claim 1, further comprising the steps of:

paying out on a 1:1 ratio to all wagers on the area on the game surface designated for wagers that the rolled dice will amount to an odd number, if an odd number is rolled; and paying out on a 1:1 ratio to all wagers on the area on the game surface designated for wagers that the rolled dice will amount to an even number, if an even number is rolled.

5. The method of playing a dice game according to claim 1, further comprising the steps of:

assigning a first color to specific numeric outcomes;

assigning a second color to remaining numeric outcomes;

paying out on a 1:1 ratio to all wagers on the area of the game surface designated for wagers that the rolled dice will amount to an outcome having a first color, if a number having a first color is rolled; and paying out on a 1:1 ratio to all wagers on the area of the game surface designated for wagers that the rolled dice will amount to an outcome having a second color, if a number having a second number is rolled.

6. The method of playing a dice game according to claim 1, further comprising the step of paying out to all wagers on an area on the game surface designated for wagers that the rolled dice will not amount to specific numbers, if said specific numbers are not rolled.

7. The method of playing a dice game according to claim 1, further comprising the step of paying out to all wagers on the area on the game surface designated for wagers that the rolled dice will amount to a single specific number, if said single specific number is rolled.

8. The method of playing a dice game according to claim 1, further comprising the step of paying out to all wagers on the area on the game surface designated for wagers that the rolled dice will amount to one of a plurality of numbers, if one of said plurality of numbers is rolled.

9. The method of playing a dice game according to claim 1, further comprising the step of paying out to all wagers on the area on the game surface designated for wagers that the rolled dice will result in any set of doubles, if any set of doubles are rolled.

10. The method of playing a dice game according to claim 1, further comprising the step of paying out to all wagers on the area on the game surface designated for half of said plurality of areas designated for wagers for specific double results, if a doubled result included in that half is rolled.

* * * * *